United States Patent [19]

Sullivan

[11] 4,056,151

[45] Nov. 1, 1977

[54] EXCAVATING TOOL

[76] Inventor: Dennis J. Sullivan, 305 S. Idaho Ave., Grangeville, Idaho 83530

[21] Appl. No.: 671,362

[22] Filed: Mar. 29, 1976

[51] Int. Cl.[2] ..... B23Q 5/00

[52] U.S. Cl. ..... 173/141; 175/170; 61/72.7; 175/62

[58] Field of Search ..... 173/141, 160; 175/58, 175/62, 170; 61/72.7; 294/58, 59, 60

[56] References Cited

U.S. PATENT DOCUMENTS

| | | | |
|---|---|---|---|
| 293,271 | 2/1884 | Philips et al. | 175/62 |
| 740,521 | 10/1903 | Brown | 175/62 |
| 826,329 | 7/1906 | Grabiel | 61/72.7 |
| 1,191,698 | 7/1916 | Hoover et al. | 175/170 |
| 1,210,187 | 12/1916 | Marquiss | 61/72.7 |
| 1,644,426 | 10/1927 | Gentsch | 175/170 |
| 2,320,612 | 1/1943 | Kandle | 175/170 |
| 3,896,890 | 7/1975 | Gale | 175/170 |

*Primary Examiner*—Robert A. Hafer

*Attorney, Agent, or Firm*—Clarence A. O'Brien; Harvey B. Jacobson

[57] ABSTRACT

An excavating tool having an auger head of conventional construction at one end of a horizontal rod with a ratchet drive for rotating said rod at the other end thereof. An outer drive tube covers the intermediate portion of said rod and a thrust washer is secured to said drive rod adjacent the auger head for receiving horizontal thrust from the outer covering drive tube. Perpendicular bars fastened to said covering tube provide engagement means for a drive bar driven into the soil for applying horizontal pressure to the auger head while the auger head is being rotated. This device permits the boring of horizontal holes beneath foundations, sidewalks, etc.

9 Claims, 5 Drawing Figures

EXCAVATING TOOL

BACKGROUND OF THE INVENTION

1. Field of the Invention

This invention relates generally to devices for boring or excavating holes beneath foundations or sidewalks for receiving sewer pipes, electrical conduits and the like.

2. Description of the Prior Art

A common problem with known excavating devices is that it is normally necessary to dig a very large hole adjacent the foundation prior to use of said devices. This involves a great deal of hand labor and time. In digging with a shovel, the bottom of the hole has to be well below the bottom of the footings so that a person can dig in a horizontal line.

Another problem with known devices is that they do not excavate an accurate, closely dimensioned hole.

Another problem with known devices is that they do not work well with medium rocky soils and/or clay-type soils.

Another problem with known devices is that they are unduly complicated and expensive, often times requiring extensive training before an operator can properly use same.

A further problem with known devices is that they do not work well under water or under flooding conditions. Also, most of them fail to sever roots and the type of obstructions which are often encountered when excavating beneath foundations.

Known prior art patents which may be pertinent to this invention are as follows:

| | | |
|---|---|---|
| 293,271 | W. J. Philips et al | Feb. 12, 1884 |
| 740,521 | O. E. Brown | Oct. 6, 1903 |
| 1,210,187 | J. E. Marquiss | Dec. 26, 1916 |

None of these known prior art devices offers the new and unique features of the invention disclosed herein.

SUMMARY OF THE INVENTION

An object of the present invention is to provide an excavating tool for boring horizontal holes beneath foundations, sidewalks, roadways and the like, and with these horizontal holes being drilled in a quite accurate manner.

Another object of the present invention is to provide an excavating tool which may be used for horizontal boring underneath foundations and the like without a substantial amount of digging required along side said foundation prior to use of said tool.

Another object of this invention is to provide an excavating tool which is of simple construction, very durable and maintenance free, and easy to operate by the ordinary unskilled laborer.

A further object of this invention is to provide an excavating tool which may be used with very poor soil type conditions. That is, rocky-type soils, clay-type soils, wet or flooded-type soils, and soils having large amounts of debris or tree roots, etc. contained therein.

A still further object of this invention is to provide a horizontal excavating tool which may be used with extensive devices for increasing the length of the horizontal hole. Such extensions are extremely useful when drilling horizontal holes beneath roadways and the like.

A still further object of this invention is to provide a device which as easily replaceable, low-cost auger heads of conventional-type construction. This greatly increases the overall value of said tool by allowing replacement of the auger head thereof whenever same becomes dull and/or unusable. Also, to change the size of the bored hole, auger heads may be changed as appropriate.

The excavating tool of this invention has a number of very important features. The device will work extremely well in all types of soil conditions normally encountered in the field, such as rocky-type soil, wet, sticky clay-type soil, and even will function well when the work site is under flooding conditions. Also, if tree roots are encountered up to the size of approximately 1½ inches, the tool is of such construction that such roots will be easily cut or severed and the tool will continue to excavate.

The tool is of relatively simple construction with a replaceable auger head of conventional construction which may be easily obtained at most of the hardware supply stores and farm supply stores throughout the country. These heads are normally available in a range of sizes. This greatly increases the value of the overall device in that when the normally wearable blades of the auger head become dull or bent, or different size holes are desired, the entire head may be quickly and easily replaced. No special skill or training is required in order to do this which also eliminates the expense of a costly mechanic.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
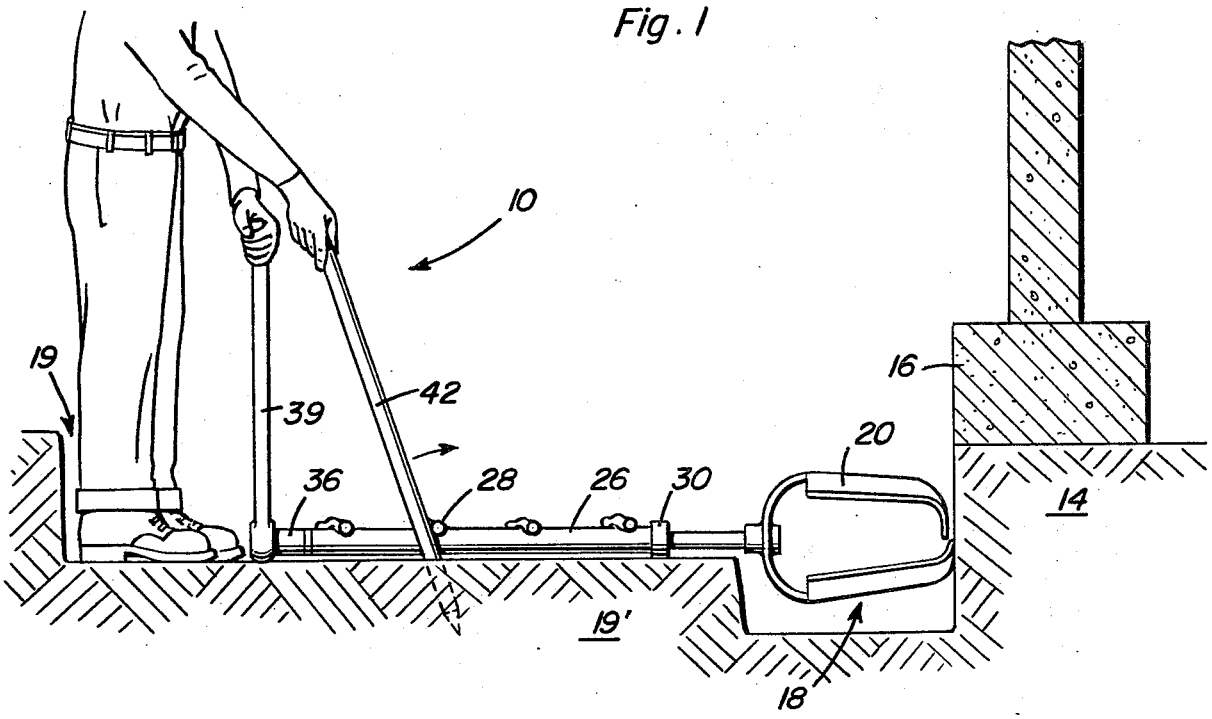
FIG. 1 is a side elevational view, partly in cross-section and partly in perspective, of the device of this invention as in use.
Figure 2:
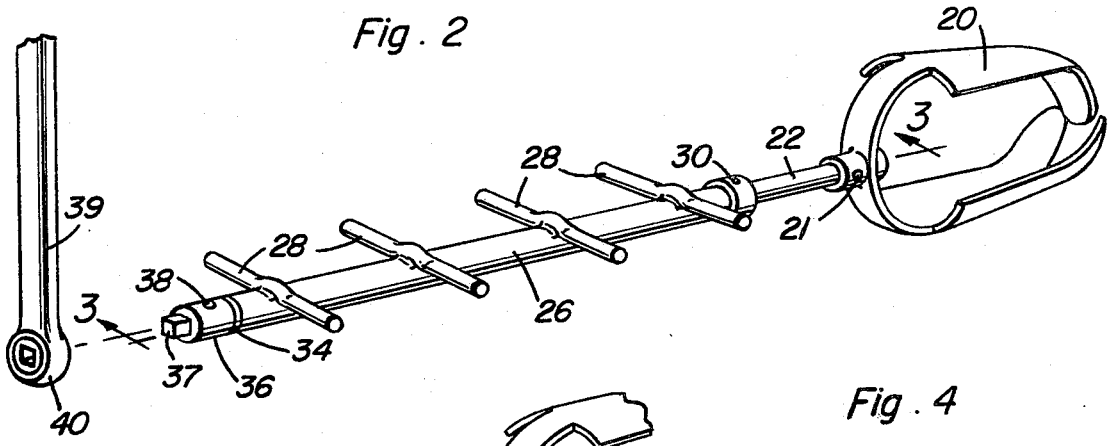
FIG. 2 is a perspective view of the preferred embodiment of the tool of this invention.
Figure 4:
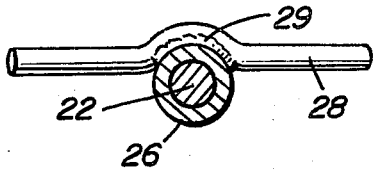
FIG. 4 is a cross-sectional view taken generally along line 4—4 of FIG. 3.
Figure 3:
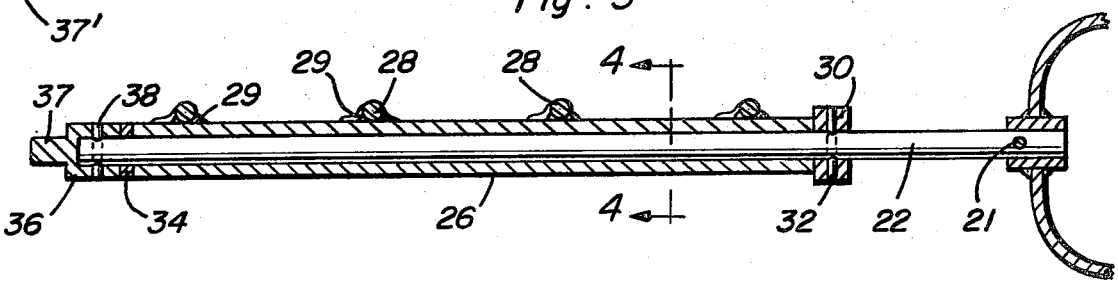
FIG. 3 is a cross-sectional view taken generally along line 3—3 of FIG. 2.

Referring to FIG. 1 of the drawings, reference numeral 10 indicates the excavating tool of this invention as in use for drilling, boring or excavating a horizontal hole underneath the foundation of a building. As better seen in FIG. 2, the excavating tool has an auger head 20 mounted at one end of a rod 22 by any suitable means such as screw threads or retaining pin 21 as shown. Surrounding the rod 22 and along the mid-portion thereof is an outer tubular covering member 26 for the purpose of exerting lateral thrust to said rod. The tube member 26 has short drive engaging members 28 appropriately fastened thereto by welding or other suitable means. Said rods or plates 28 are fastened perpendicular to the tube 26 and, as best seen in FIG. 3, are fastened by welding 29. A thrust collar or washer 30 is normally provided a short distance from the auger head and appropriately fastened by pin 32 or by welding, not shown, to the rod 22. This thrust collar 30 is for the purpose of transmitting pressure which is exerted upon the tube 26 through the bars 28 by means of a ground engaging rod 42, as best seen in FIG. 1.

At the extreme other end of rod 22 from the auger head are means for rotating the drive rod 22. As seen in FIGS. 2 and 3, this consists of a washer 34 and a ratchet socket 36 appropriately fastened to rod 22. As shown, a pin 38 is used for fastening same, but welding may also be used or screw threads as desired. A ratchet engaging projection 37 is appropriately provided on the member 36. As seen in FIGS. 1 and 2, a ratchet mechanism 39, 40 is appropriately mounted on the member 37 for rotation of the drive rod 22 in a step-by-step manner as is conventional with ratchet drives.

Obviously, a suitable extension may be added at the auger end by simply removing the pin 21 and replacing the auger head with the extension piece with the auger head then being added onto the other end of said extension piece. If galvanized pipe or rods are used for 22 having screw threads at either end, then an appropriately threaded coupling would be used for the extension.

In operation, as best viewed in FIG. 1, the ground engaging rod 42 is appropriately driven or forced into the earth cavity 19' for applying pressure as indicated by the small arrow sideways or laterally against the auger head. At the same time the operator applies pressure via rod 42 said operator also operates the ratchet 39, 40 to rotate the auger head in the desired direction. A small channel 18 normally must be provided beside the foundation base in order to allow the auger head to enter the earth directly beneath the foundation and slightly therebelow. However, the amount of hand digging required for the channels 19 and 18 is very small compared to what is normally required for known-type digging devices or the usual type hand digging.

Figure 5:
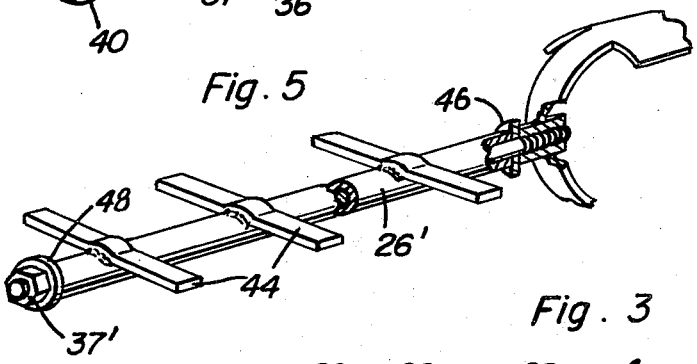
FIG. 5 is a perspective view of a second embodiment of the tool of this invention.

Another embodiment of this excavating tool is shown in FIG. 5 wherein like reference numerals are used for like parts. The primary difference in the tool of this embodiment is that a thrust washer 46 is used directly between the covering drive tube member 26' and the auger head. Another washer 48 is used at the other end of the rod and drive tube and this end of the rod ends in a nut 37' which is welded, screwed, or appropriately fastened to the end of rod 22. Instead of using the drive rods like 28 of the preferred embodiment, flat rectangular strips 44 welded or appropriately fastened to the outer drive tube 26' are used.

In both embodiments the internal drive rod 22 would normally be of approximately ¾-inch diameter and the outer tube would be of approximately 1¼-inch diameter.

The device as envisioned by this invention offers substantial improvements and advantages over known devices in the art. Conventional auger heads may be used and easily replaced with this device and maintenance and operation are simple and inexpensive.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An excavating tool comprising: means of simple construction, very durable and maintenance free, and easy to operate by the ordinary unskilled laborer including; and easily replaceable auger head for excavating earth and the like, drive means attached to said auger head for rotating same for excavating purposes, second means associated with the drive means for applying pressure to the auger head in a substantially longitudinal direction to force the auger head to bite into the earth, the drive means attached to said auger head being a substantially long rod member, third means being secured to the other end of said rod member from the auger head for attachment to a ratchet actuating mechanism, the second means associated with the drive means for applying pressure to the auger head including a longitudinally extending tube member covering and enclosing a substantial intermediate portion of sid rod member between the auger head and the ratchet mechanism, and the second means including at least one perpendicular cross member attached to the outer side of said tube member and engaged by external ground engaging means for applying lateral pressure thereto.

2. The structure as set forth in claim 1, wherein at least three of said perpendicular cross members are fastened to the outer side of said covering tube member so that different ones of the cross members may be engaged by the external ground engaging means in step-by-step fashion as the excavating progresses.

3. The structure as set forth in claim 2, wherein the external ground engaging means for applying lateral pressure to the cross members includes a ground engaging rod which has a sharp point for being driven into the earth with the side of said rod engaging one of said cross members when lateral pressure is applied by an operator to the other end of said rod.

4. An excavating tool for making a substantially horizontal hole underneath foundation footings and the like comprising: an easily replaceable excavating head member, a horizontal drive pipe removably attached to the head member, a horizontal tube enclosing the drive pipe over a substantial portion thereof, a plurality of members fastened to the outside of the horizontal tube and at right angles thereto, a ground engaging rod for exerting horizontal pressure on the plurality of members individually in a step-by-step manner as excavating is being done, and means at the other end of the drive pipe from the excavating head member for rotating same.

5. The structure as set forth in claim 4, wherein the rotating means at the end of the drive pipe includes a ratchet mechanism removably mounted on said drive pipe.

6. The structure as set forth in claim 5, including a drive collar between the excavating head member and the horizontal tube which collar is fastened to said drive pipe and engages with said tube for transferring horizontal thrust pressure on the plurality of members to said drive pipe.

7. The structure as set forth in claim 6, together with a washer between the ratchet mechanism on the drive pipe and the tube enclosing the drive pipe.

8. The structure as set forth in claim 4, wherein the plurality of members fastened to the outside of the horizontal tube at right angles thereto consist of four evenly spaced short rods welded to said horizontal tube and extending outwardly from both sides of said tube to form stabilizer members for the tube as well as horizontal force transmitting members.

9. The structure as set forth in claim 4, further including a thrust washer between the replaceable excavating head member and the horizontal tube enclosing the drive pipe for directly transferring thrust as applied to said horizontal tube from the plurality of members fastened at right angles thereto and as exerted thereon by the ground engaging rod for exerting pressure thereon.

* * * * *